US007430854B2

(12) United States Patent
Yasui et al.

(10) Patent No.: US 7,430,854 B2
(45) Date of Patent: Oct. 7, 2008

(54) AIR FUEL RATIO CONTROLLER FOR INTERNAL COMBUSTION ENGINE FOR STOPPING CALCULATION OF MODEL PARAMETERS WHEN ENGINE IS IN LEAN OPERATION

(75) Inventors: Yuji Yasui, Wako (JP); Akihiro Shinjo, Wako (JP); Tatsuhito Esaki, Wako (JP); Naoto Fujimura, Wako (JP)

(73) Assignee: Honda Giken Kogyo Kabushiki Kaisha, Minato-Ku, Tokyo (JP)

( * ) Notice: Subject to any disclaimer, the term of this patent is extended or adjusted under 35 U.S.C. 154(b) by 247 days.

(21) Appl. No.: 10/653,146

(22) Filed: Sep. 3, 2003

(65) Prior Publication Data

US 2004/0040283 A1 Mar. 4, 2004

(30) Foreign Application Priority Data

Sep. 4, 2002 (JP) ..... 2002-259285

(51) Int. Cl.
*F01N 3/00* (2006.01)

(52) U.S. Cl. ..... 60/285; 60/274; 60/276; 123/198 F; 123/481

(58) Field of Classification Search ..... 60/274, 60/276, 277, 285; 123/198 F, 481
See application file for complete search history.

(56) References Cited

U.S. PATENT DOCUMENTS 5,570,575 A * 11/1996 Sato et al. ..... 60/277
5,842,340 A * 12/1998 Bush et al. ..... 60/274
6,079,205 A * 6/2000 Yasui et al. ..... 60/276
6,405,527 B2 * 6/2002 Suzuki et al. ..... 60/285
6,408,618 B2 * 6/2002 Ide ..... 60/285
6,415,601 B1 * 7/2002 Glugla et al. ..... 60/284
6,732,506 B2 * 5/2004 Patterson et al. ..... 60/285
6,892,527 B2 * 5/2005 Ueda et al. ..... 60/277
7,104,047 B2 * 9/2006 Takubo ..... 60/285
7,111,450 B2 * 9/2006 Surnilla ..... 60/285

FOREIGN PATENT DOCUMENTS

JP 04-342847 11/1992
JP 11-153051 6/1999
JP 2000-234550 8/2000

* cited by examiner

*Primary Examiner*—Tu M Nguyen
(74) *Attorney, Agent, or Firm*—Squire, Sanders & Dempsey, L.L.P.

(57) ABSTRACT

An air fuel ratio controller for an internal combustion engine includes an exhaust gas sensor, an identifier and a control unit. The exhaust gas sensor detects oxygen concentration of exhaust gas. The identifier calculates model parameters for a model of a controlled object based on the output of the exhaust gas sensor. The controlled object includes an exhaust system of the engine. The control unit is configured to use the model parameters to control the air-fuel ratio so that the output of the exhaust gas sensor converges to a desired value, and to stop the identifier from calculating the model parameters during and immediately after the engine operation with a lean air-fuel ratio. The calculation of the model parameters may be also stopped during and immediately after fuel-cut operation that stops fuel supply to the engine. Such a stop of the calculation of the model parameters reduces the emission of undesired substances contained in exhaust gas when the engine shifts from lean operation to stoichiometric/rich operation.

24 Claims, 11 Drawing Sheets

AIR FUEL RATIO CONTROLLER FOR INTERNAL COMBUSTION ENGINE FOR STOPPING CALCULATION OF MODEL PARAMETERS WHEN ENGINE IS IN LEAN OPERATION

BACKGROUND OF THE INVENTION

1. Field of the Invention

The invention relates to a controller for controlling an air-fuel ratio based on the output of an exhaust gas sensor disposed in an exhaust system of an internal-combustion engine.

2. Description of the Related Art

A catalyst converter is provided in an exhaust system of an internal combustion engine of a vehicle. When the air-fuel ratio of air-fuel mixture introduced into the engine is lean, the catalyst converter oxidizes HC and CO with excessive oxygen included in the exhaust gas. When the air-fuel ratio is rich, the catalyst converter reduces NOx with HC and CO. When the air-fuel ratio is in the stoichiometric air-fuel ratio region, HC, CO and NOx are simultaneously and effectively purified.

An exhaust gas sensor is provided downstream of the catalyst converter. The exhaust gas sensor detects the concentration of oxygen included in the gas that is discharged into the exhaust system. Feedback control for the air-fuel ratio of the engine is performed based on the output of the exhaust gas sensor.

As an example of the feedback control for the air-fuel ratio, Japanese Patent Application Unexamined Publication No. 2000-234550 proposes a response assignment control in which a switching function is defined. This control converges the output of the exhaust gas sensor to a desired value by converging the value of the switching function to zero. A desired air-fuel ratio (or manipulated variable) for converging the output of the exhaust gas sensor to the desired value is calculated. A fuel amount to be supplied to the engine is controlled according to the desired air-fuel ratio.

A system identifier may be provided in a system that performs the response assignment control. The system identifier calculates model parameters associated with an object of the response assignment control. The model parameters calculated by the system identifier are used to determine the desired air-fuel ratio.

Recently, there is a trend to expand an operating range in which the engine is operated with a lean air-fuel ratio so as to improve fuel efficiency. When a desired engine operation cannot be achieved with a lean air-fuel ratio, the air-fuel ratio is changed to the stoichiometric air-fuel ratio or a rich air-fuel ratio. When the engine is operated with the stoichiometric air-fuel ratio, air-fuel ratio control according to the above response assignment control is performed so as to reduce the emission of undesired substances contained in exhaust gas.

Engine operation with a lean air-fuel ratio may be also activated immediately after the engine is started. Such lean engine operation is performed so as to reduce the emission of undesired substances contained in exhaust gas.

According to a conventional air-fuel ratio control, only in lean engine operation activated immediately after the engine is started, the calculation of the model parameters by the identifier is stopped. In lean engine operation activated so as to improve fuel efficiency, the identifier continues calculating the model parameters, and the calculation of the desired air-fuel ratio by using the calculated model parameters is stopped.

FIG. 14 shows behavior of parameters according to such a conventional air-fuel ratio control. An exhaust gas sensor output Vo2/OUT, model parameters a1 and a2, a desired air fuel ratio KCMD, an actual air-fuel ratio KACT, and the amount of undesired substances HC and NOx contained in exhaust gas are shown.

During engine operation with a lean air-fuel ratio (t1 to t2) and immediately after the lean engine operation (t2 to t4), the exhaust gas sensor output Vo2/OUT and the actual air-fuel ratio KACT exhibit a lean air-fuel ratio. During a period from t1 to t4, the identifier continues calculating the model parameters a1 and a2 based on the exhaust gas sensor output Vo2/OUT and the actual air fuel ratio KACT. Since the exhaust gas sensor output Vo2/OUT and the actual air fuel ratio KACT have a constant lean air-fuel ratio, the accuracy of identifying the model parameters a1 and a2 deteriorates. The model parameters drift as shown in the period from t2 to t4.

The desired air fuel ratio KCMD is held at a predetermined value (for example, 1) during the lean engine operation (t1 to t2). At time t2 at which the lean engine operation is terminated, an adaptive air-fuel ratio control is started and the calculation of the desired air fuel ratio KCMD is also started.

During a period from t2 to t3, the desired air-fuel ratio needs to be manipulated to become rich so as to promptly return the output of the exhaust gas sensor from the lean side to the desired value Vo2/TARGET. However, due to the drift of the model parameters, the desired air-fuel ratio KCMD is changed toward the lean side as shown by reference number 201. As a result, the air-fuel ratio is manipulated to converge to the lean desired air-fuel ratio KCMD, thereby increasing Nox emission.

During a period from t3 to t4, the desired air-fuel ratio needs to be manipulated to change toward the lean side so as to cause the output of the exhaust gas sensor to converge to the desired value Vo2/TARGET. However, due to the drift of the model parameters, the desired air-fuel ratio KCMD is changed toward the rich side as shown by reference number 202. As a result, the air-fuel ratio is manipulated to converge to the rich desired air-fuel ratio KCMD, thereby increasing HC emission.

Thus, as shown in the period from t2 to t4, drift of the model parameters may make the calculation of the desired air-fuel ratio KCMD inappropriate. An inappropriate desired air-fuel ratio increases NOx and HC. Such increase of NOx and HC may also occur when fuel-cut operation that stops fuel supply to the engine is performed.

Therefore, there is a need for an apparatus and a method capable of stopping the identifier from calculating the model parameters during and immediately after such lean engine operation and fuel-cut operation.

SUMMARY OF THE INVENTION

According to one aspect of the invention, an air-fuel ratio controller for an internal combustion engine comprises an exhaust gas sensor, a system identifier and a control unit. The exhaust gas sensor detects oxygen concentration of exhaust gas. The system identifier calculates model parameters for a model of an object controlled by the air-fuel ratio control based on the output of the exhaust gas sensor. The controlled object includes an exhaust system of the engine. The control unit uses the model parameters to control the air-fuel ratio so that the output of the exhaust gas sensor converges to a desired value. The control unit stops the identifier from calculating the model parameters when the engine is operating with a lean air-fuel ratio and during a predetermined period after the engine stops operating with a lean air-fuel ratio.

According to the invention, an appropriate desired air-fuel ratio can be determined when the engine shifts from lean operation to stoichiometric/rich operation because the calculation of model parameters is stopped during and immediately after the lean engine operation. Such an appropriate desired air-fuel ratio reduces the emission of undesired substances after the lean engine operation is stopped.

According to one embodiment of the invention, the control unit further stops the identifier from calculating the model parameters when fuel-cut operation that stops fuel supply to the engine is being performed and during a predetermined period immediately after the fuel-cut operation is stopped.

According to the invention, an appropriate desired air-fuel ratio can be determined when the engine shifts from fuel-cut operation to stoichiometric/rich operation because the calculation of model parameters is stopped during and immediately after the fuel-cut operation. Such an appropriate desired air-fuel ratio reduces the emission of undesired substances after the fuel-cut operation is stopped.

According to one embodiment of the invention, when the engine is operating with a lean air-fuel ratio and during a predetermined period after the engine stops operating with a lean air-fuel ratio, the control unit continues determining a desired air-fuel ratio based on the model parameters last calculated before the engine started operating with a lean air-fuel ratio. Air-fuel mixture is generated in accordance with the determined desired air-fuel ratio. Thus, when the engine shifts from lean operation to stoichiometric/rich operation, the air-fuel ratio control is performed with an appropriate desired air-fuel ratio.

According to one embodiment of the invention, the engine operates with a lean air-fuel ratio to improve fuel efficiency. The engine also operates with a lean air-fuel ratio to reduce the emission of undesired substances included in exhaust gas immediately after the engine is started.

According to one embodiment of the invention, the air-fuel ratio is controlled by a response assignment control. The response assignment control is capable of specifying a convergence rate of the controlled variable or the output of the exhaust gas sensor.

According to one embodiment of the invention, the exhaust system extends from an air-fuel ratio sensor through a catalyst converter to the exhaust gas sensor. The air-fuel ratio sensor is provided upstream of the catalyst converter. The exhaust gas sensor is typically provided downstream of the catalyst converter. The exhaust system is modeled so that a control input of the model is represented by the output of the air-fuel ratio sensor and a control output of the model is represented by the output of the exhaust gas sensor.

DESCRIPTION OF THE PREFERRED EMBODIMENTS

Structure of Internal-combustion Engine and Control Apparatus

Figure 1:
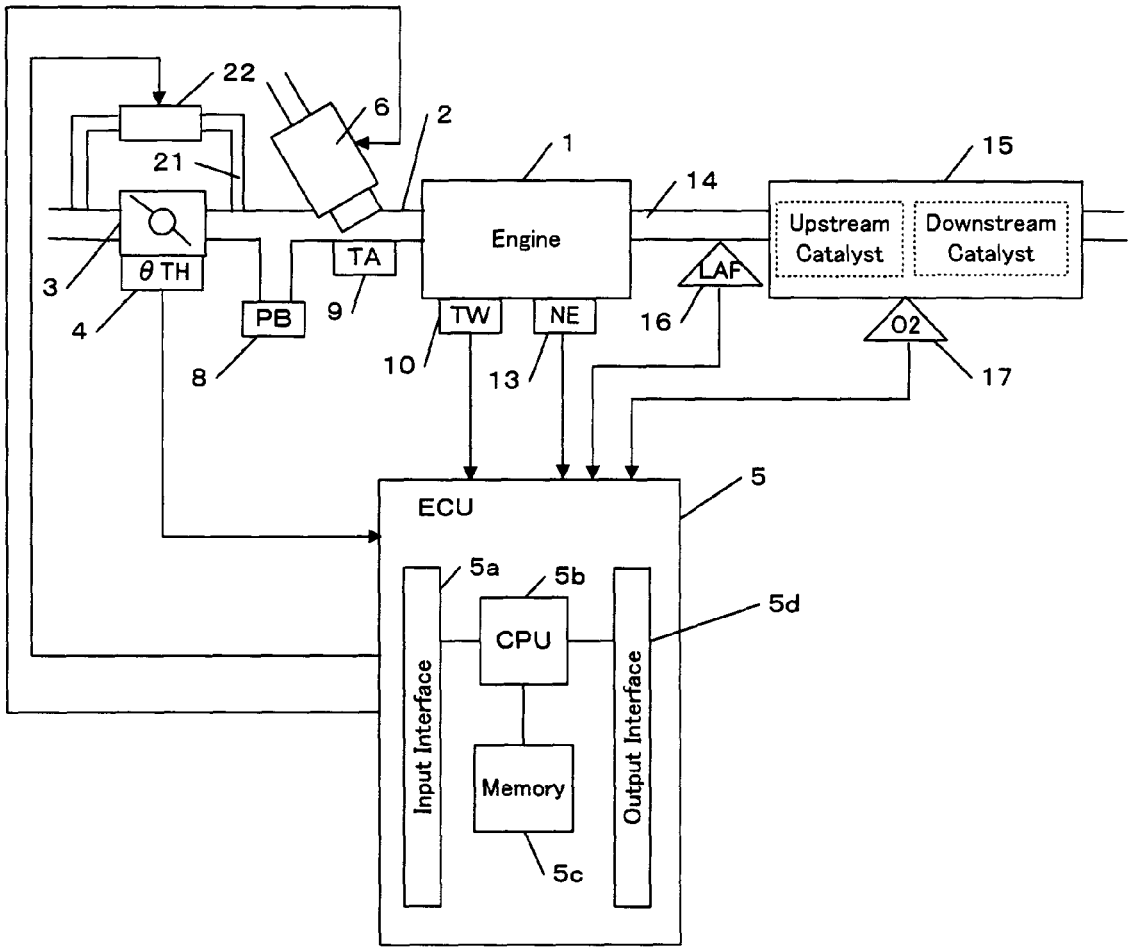
FIG. 1 is a schematic view of an internal combustion engine and its controller according to one embodiment of the present invention.

Preferred embodiments of the present invention will be described referring to the attached drawings. FIG. 1 is a block diagram showing a controller of an internal-combustion engine (hereinafter referred to as an engine) in accordance with one embodiment of the invention.

An electronic control unit (hereinafter referred to as ECU) 5 comprises an input interface 5*a* for receiving data sent from each part of the engine 1, a CPU 5*b* for carrying out operations for controlling each part of the engine 1, a storage device 5*c* including a read only memory (ROM) and a random access memory (RAM), and an output interface 5*d* for sending control signals to each part of the engine 1. Programs and various data for controlling each part of the vehicle are stored in the ROM. A program for controlling an air-fuel ratio according to the invention, data and tables used for operations of the program are stored in the ROM. The ROM may be a rewritable ROM such as an EEPROM. The RAM provides work areas for operations by the CPU 5*a*, in which data sent from each part of the engine 1 as well as control signals to be sent out to each part of the engine 1 are temporarily stored.

The engine 1 is, for example, an engine equipped with four cylinders. An intake manifold 2 is connected to the engine 1. A throttle valve 3 is disposed upstream of the intake manifold 2. A throttle valve opening (θTH) sensor 4, which is connected to the throttle valve 3, outputs an electric signal corresponding to an opening angle of the throttle valve 3 and sends it to the ECU 5.

A bypass passage 21 for bypassing the throttle valve 3 is provided in the intake manifold 2. A bypass valve 22 for controlling the amount of air to be supplied into the engine 1 is provided in the bypass passage 21. The bypass valve 22 is driven in accordance with a control signal from the ECU 5.

A fuel injection valve 6 is provided for each cylinder at an intermediate point in the intake manifold 2 between the engine 1 and the throttle valve 3. The fuel injection valve 6 is connected to a fuel pump (not shown) to receive fuel supplied from a fuel tank (not shown). The fuel injection valve 6 is driven in accordance with a control signal from the ECU 5.

An intake manifold pressure (Pb) sensor 8 and an outside air temperature (Ta) sensor 9 are mounted in the intake manifold 2 downstream of the throttle valve 3. The detected intake manifold pressure Pb and outside air temperature Ta are sent to the ECU 5.

An engine water temperature (TW) sensor 10 is attached to the cylinder peripheral wall, which is filled with cooling water, of the cylinder block of the engine 1. The temperature of the engine cooling water detected by the TW sensor is sent to the ECU 5.

A rotational speed (Ne) sensor 13 is attached to the periphery of the camshaft or the periphery of the crankshaft (not shown) of the engine 1, and outputs a CRK signal pulse at a predetermined crank angle cycle (for example, a cycle of 30 degrees) that is shorter than a TDC signal pulse cycle issued at a crank angle cycle associated with a TDC position of the piston. CRK pulses are counted by the ECU 5 to determine the rotational speed Ne of the engine 1.

An exhaust manifold 14 is connected to the engine 1. The engine 1 discharges exhaust gas through the exhaust manifold 14. A catalyst converter 15 removes undesired substances such as HC, CO, and NOx included in the exhaust gas flowing through the exhaust manifold 14. The catalyst converter 15 comprises two catalysts, an upstream catalyst and a downstream catalyst.

A full range air-fuel ratio (LAF) sensor 16 is provided upstream of the catalyst converter 15. The LAF sensor 16 linearly detects the concentration of oxygen included in exhaust gas over a wide air-fuel ratio zone, from the rich zone where the air-fuel ratio is richer than the stoichiometric air-fuel ratio to an extremely lean zone. The detected oxygen concentration is sent to the ECU 5.

An O2 (exhaust gas) sensor 17 is provided between the upstream catalyst and the downstream catalyst. The O2 sensor 17 is a binary-type of exhaust gas concentration sensor. The O2 sensor outputs a high level signal when the air-fuel ratio is richer than the stoichiometric air-fuel ratio, and outputs a low level signal when the air-fuel ratio is leaner than the stoichiometric air-fuel ratio. The electric signal is sent to the ECU 5.

Signals sent to the ECU 5 are passed to the input circuit 5*a*. The input interface 5*a* converts analog signal values into digital signal values. The CPU 5*b* processes the resulting digital signals, performs operations in accordance with the programs stored in the memory 5*c*, and creates control signals. The output interface 5*d* sends these control signals to actuators for the bypass valve 22, fuel injection valve 6 and other mechanical components.

Figure 2:
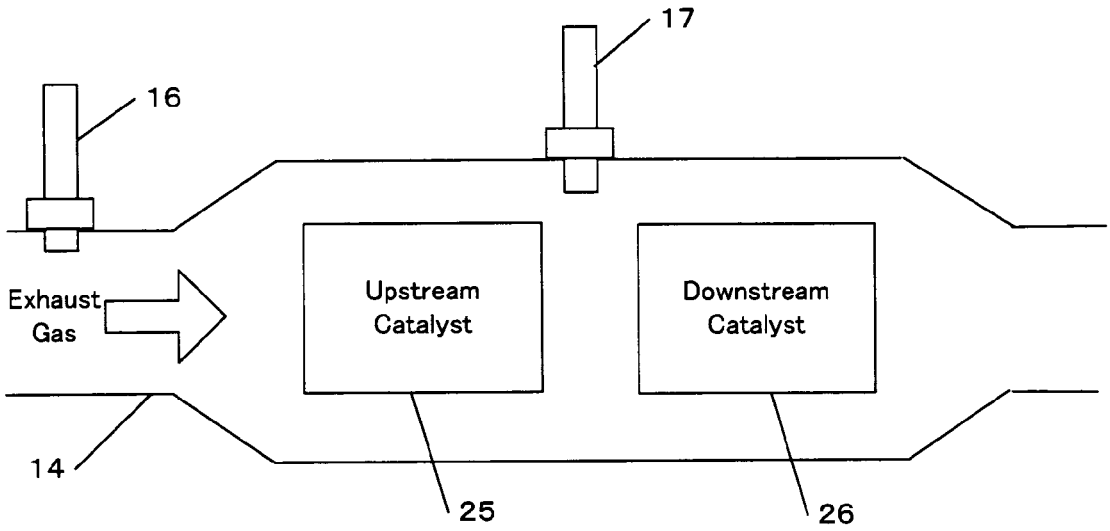
FIG. 2 is a view of layout of a catalyst converter and an exhaust gas sensor according to one embodiment of the present invention.

FIG. 2 shows a structure of the catalyst converter 15. Exhaust gas introduced into the exhaust manifold 14 passes through the upstream catalyst 25 and then through the downstream catalyst 26. It is known that it is easier to maintain the purification rate of NOx at an optimal level by air-fuel ratio control based on the output of an O2 sensor provided between the upstream and downstream catalysts, compared with air-fuel ratio control based on the output of an O2 sensor provided downstream of the downstream catalyst. Therefore, in the embodiment of the invention described hereafter, the O2 sensor 17 is provided between the upstream and downstream catalysts. The O2 sensor 17 detects the concentration of oxygen included in the exhaust gas after the passage through the upstream catalyst 25.

Alternatively, the O2 sensor may be disposed downstream of the downstream catalyst 26. If the catalyst converter 15 is implemented with a single catalyst, the O2 sensor is disposed downstream of the catalyst converter 15.

Figure 3:
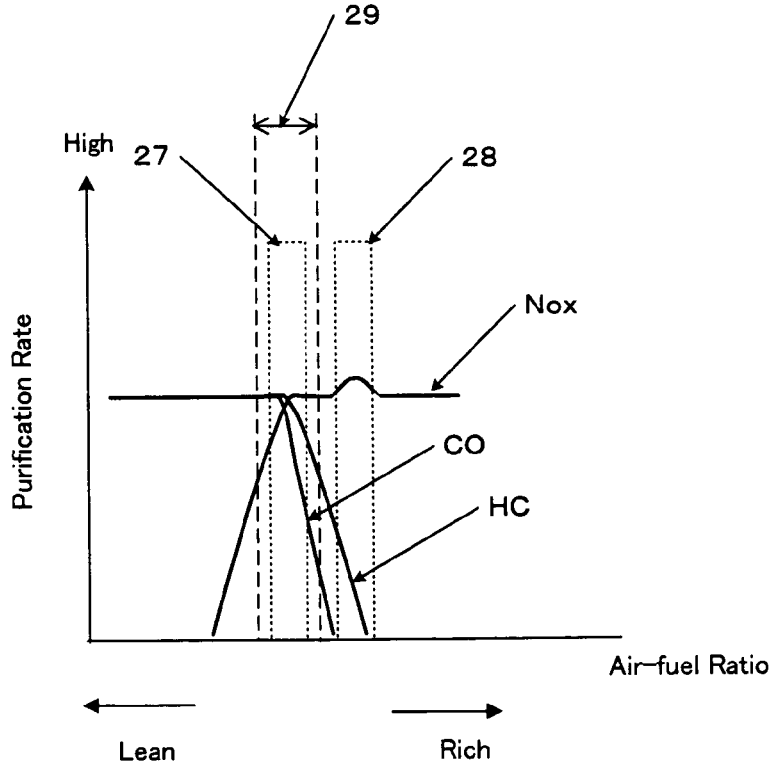
FIG. 3 shows an outline of air-fuel ratio control according to one embodiment of the present invention.

FIG. 3 shows purification behavior of the upstream catalyst and the downstream catalyst. A window 27 indicates an air-fuel ratio region in which CO, HC and NOx are optimally purified. Since oxygen included in exhaust gas is consumed by the purification in the upstream catalyst 25, the exhaust gas supplied to the downstream catalyst 26 exhibits a reduction atmosphere (i.e., a rich state) as shown by a window 28. In such a reduction atmosphere, NOx is further purified. Thus, the cleaned exhaust gas is discharged.

In order to optimally maintain the purification performance of the catalyst converter 15, adaptive control of the air-fuel ratio according to the invention causes the output of the O2 sensor 17 to converge to a desired value so that the air-fuel ratio is within the window 27.

A reference number 29 shows an allowable range that defines a limitation of a variable manipulated by the adaptive air-fuel ratio control, which will be described in detail later.

Figure 4:
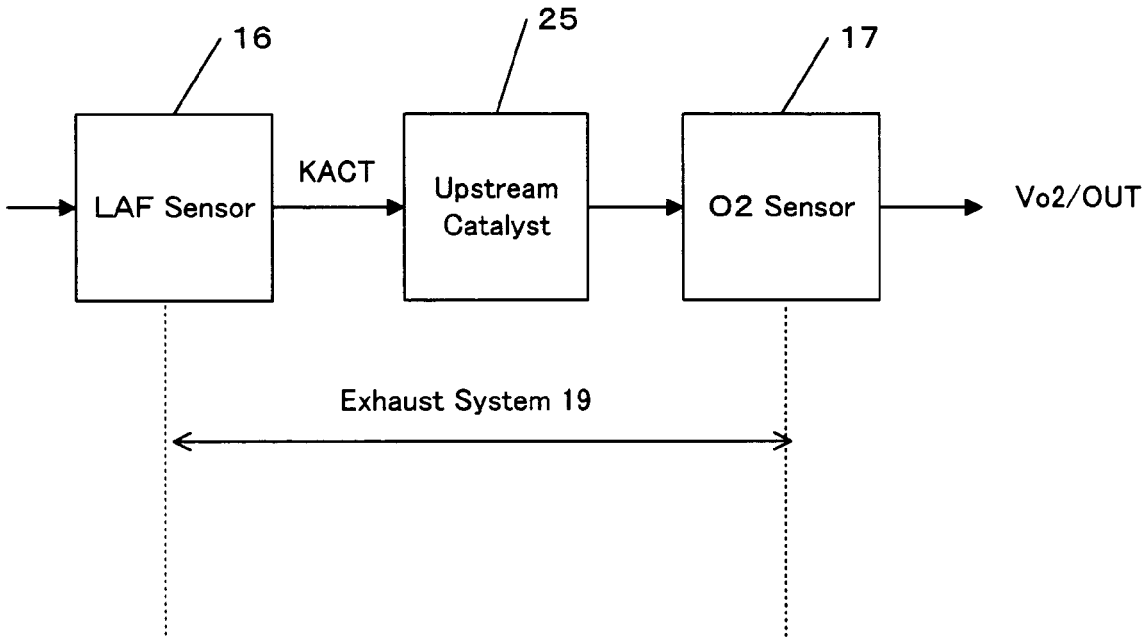
FIG. 4 is a block diagram of an exhaust system that is a controlled object according to one embodiment of the present invention.

FIG. 4 is a block diagram of an exhaust system extending from the LAF sensor 16 to the O2 sensor 17. The LAF sensor 16 detects an air-fuel ratio Kact of the exhaust gas supplied to the upstream catalyst 25. The O2 sensor 17 outputs a voltage Vo2/OUT representing the oxygen concentration of the exhaust gas after the purification by the upstream catalyst 25. The exhaust system 19 is an object to be controlled, or a plant of the adaptive air-fuel ratio control according to the invention.

Adaptive Air-fuel Ratio Control

Figure 5:
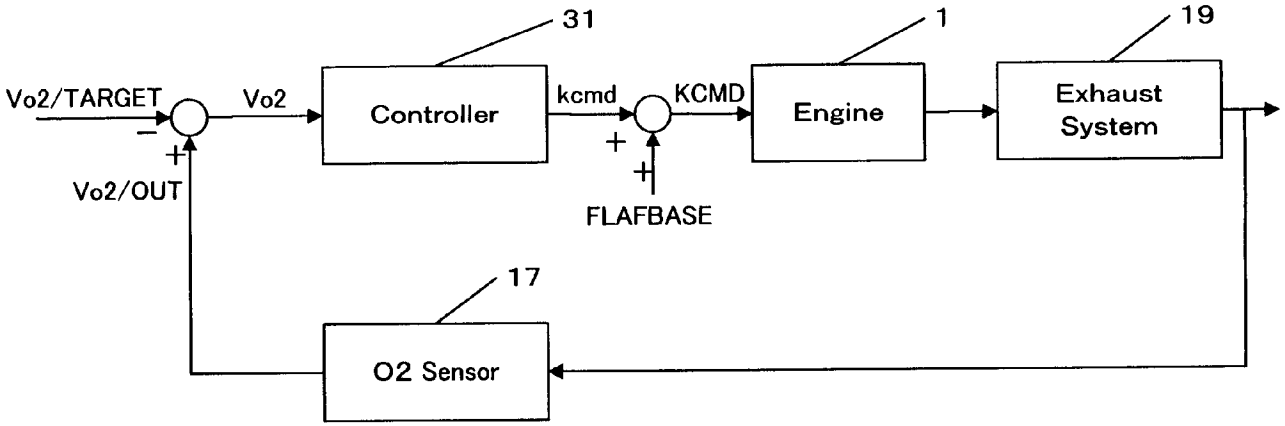
FIG. 5 is a block diagram of air-fuel ratio control according to one embodiment of the present invention.

FIG. 5 shows a block diagram of an adaptive air-fuel ratio control in accordance with one embodiment of the invention. The output Vo2/OUT of the O2 sensor 17 is compared with a desired value Vo2/TARGET. A controller 31 determines a desired air-fuel ratio error "kcmd" based on the comparison result. The desired air-fuel ratio error kcmd is added to a base value FLAF/BASE to determine a desired air-fuel ratio KCMD. The amount of fuel injection corrected with the desired air-fuel ratio KCMD is supplied to the engine. The output Vo2/OUT of the O2 sensor 17 of the exhaust system is detected again.

Thus, the controller 31 performs a feedback control to determine the desired air-fuel ratio KCMD so that the output Vo2/OUT of the O2 sensor 17 converges to the desired value Vo2/TARGET. The exhaust system 19, which is a controlled object, can be modeled as shown by the equation (1) in which Vo2/OUT is defined as a control output and the output KACT of the LAF sensor is defined as a control input. The exhaust system 19 is modeled as a discrete-time system. Such modeling can make the air-fuel ratio control algorithm simple and suitable for computer processing. "k" is an identifier for identifying a control cycle.

$$Vo2(k+1)=a1\cdot Vo2(k)+a2\cdot Vo2(k-1)+b1\cdot kact(k-d1)$$
$$\text{where } Vo2(k)=Vo2/\mathrm{OUT}(k)-Vo2/\mathrm{TARGET} \quad (1)$$

A sensor output error Vo2 indicates an error between the O2 sensor output Vo2/OUT and the desired value Vo2/TARGET. An actual air-fuel ratio error "kact" indicates an error between the LAF sensor output KACT and the base value FLAF/BASE. The base value FLAF/BASE is set to be a central value for the desired air-fuel ratio. For example, the base value is set to a value indicative of stoichiometry (that is, FLAF/BASE=1). The base value FLAF/BASE may be a constant value, or may be established according to the operating state of the engine.

"d1" indicates a dead time in the exhaust system 19. The dead time d1 is a time required for the air-fuel ratio detected by the LAF sensor 16 to be reflected in the output of the O2 sensor 17. "a1", "a2" and "b1" are model parameters, which are generated by a system identifier. The system identifier will be described later.

On the other hand, an air-fuel ratio manipulating system comprising the engine and the ECU 5 can be modeled as shown by the equation (2). The desired air-fuel ratio error "kcmd" indicates an error between the desired air-fuel ratio KCMD and the base value FLAF/BASE (kcmd=KCMD-FLAF/BASE). "d2" indicates a dead time in the air-fuel ratio manipulating system 18. The dead time d2 is a time required for the calculated desired air-fuel ratio KCMD to be reflected in the output KACT of the LAF sensor 16.

$$kact(k)=kcmd(k-d2) \tag{2}$$

Figure 6:
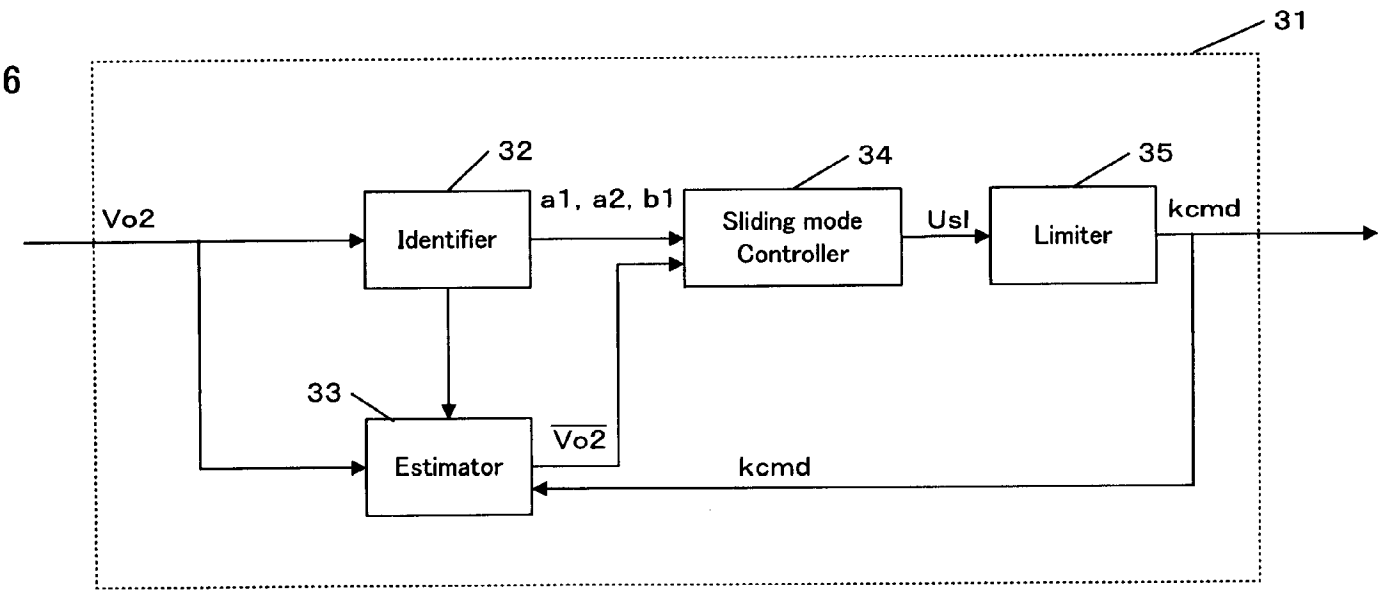
FIG. 6 is a detailed functional block diagram of an air-fuel ratio controller according to one embodiment of the present invention.

FIG. 6 shows a more detailed block diagram of the controller 31 shown in FIG. 5. The controller 31 comprises a system identifier 32, an estimator 33, a sliding mode controller 34, and a limiter 35.

The identifier 32 identifies the model parameters a1, a2 and b1 in the equation (1) so that modeling errors are removed. The system identification performed by the identifier 32 will be described.

The identifier 32 uses model parameters $\hat{a}1(k-1)$, $\hat{a}2(k-1)$ and $\hat{b}1(k-1)$ that have been calculated in the previous control cycle to determine a sensor output error $\hat{Vo}2(k)$ for the current cycle in accordance with the equation (3).

$$\begin{aligned} \hat{Vo}2(k) = {} & \hat{a}1(k-1)\cdot Vo2(k-1) + \\ & \hat{a}2(k-1)\cdot Vo2(k-2) + \\ & \hat{b}1(k-1)\cdot kact(k-d1-1) \end{aligned} \tag{3}$$

The equation (4) indicates an error id/e(k) between the sensor output error Vo2(k) that is calculated in accordance with the equation (3) and a sensor output error Vo2(k) that is actually detected in the current control cycle.

$$id/e(k)=Vo2(k)-\hat{Vo}2(k) \tag{4}$$

The identifier 32 calculates a1(k), a2(k) and b1(k) for the current cycle so that the error id/e(k) is minimized. Here, a vector θ is defined as shown in the equation (5).

$$\Theta^T(k)=[\hat{a}1(k)\hat{a}2(k)\hat{b}1(k)] \tag{5}$$

The identifier 32 determines $\hat{a}$1(k), $\hat{a}$2(k) and $\hat{b}$1(k) in accordance with the equation (6). As shown by the equation (6), $\hat{a}$1(k), $\hat{a}$2(k) and $\hat{b}$1(k) for the current control cycle are calculated by changing $\hat{a}$1(k), $\hat{a}$2(k) and $\hat{b}$1(k) calculated in the previous control cycle by an amount proportional to the error id/e(k).

$$\Theta(k)=\Theta(k-1)+K\Theta(k)\cdot id/e(k) \tag{6}$$

The vector Kθ is determined in accordance with the equation (7).

$$K\theta(k) = \frac{P(k-1)\xi(k)}{1+\xi^T(k)P(k-1)\xi(k)} \tag{7}$$

$$\text{where } \xi^T(k) = [\ Vo2(k-1) \quad Vo2(k-2) \quad kact(k-d1-1)\ ]$$

The matrix P is determined in accordance with the equation (8). The initial value P(0) of the matrix P is a diagonal matrix in which each diagonal element has a positive value.

$$P(k) = \frac{1}{\lambda 1(k)}\left[I - \frac{\lambda 2(k)P(k-1)\xi(k)\xi^T(k)}{\lambda 1(k)+\lambda 2(k)\xi^T(k)P(k-1)\xi(k)}\right]P(k-1) \tag{8}$$

$$\text{where} \quad 0<\lambda 1\le 1 \quad 0<\lambda 2\le 2 \quad I:\text{unit matrix}$$

Estimation performed by the estimator 33 will be described. In order to compensate the dead time "d1" of the exhaust system 19 and the dead time "d2" of the air-fuel ratio manipulating system, the estimator 33 estimates a sensor output error Vo2 after the dead time d (=d1+d2). Specifically, the model equation (2) for the air-fuel manipulating system is applied to the model equation (1) for the exhaust system to derive the equation (9).

$$\begin{aligned} Vo2(k+1) &= a1\cdot Vo2(k) + a2\cdot Vo2(k-1) + b1\cdot kcmd(k-d1-d2) \\ &= a1\cdot Vo2(k) + a2\cdot Vo2(k-1) + b1\cdot kcmd(k-d) \end{aligned} \tag{9}$$

The model equation (9) indicates a system comprising the exhaust system 19 and the air-fuel ratio manipulating system. The equation (9) is used to determine an estimated value $\overline{Vo2}$(k+d) for the sensor output error Vo2(k+d) after the dead time, as shown by the equation (10). Coefficients α1, α2 and β are calculated using the model parameters determined by the identifier 32. Past time-series data kcmd(k-j) (wherein, j=1, 2, . . . d) of the desired air-fuel ratio error includes desired air-fuel ratio errors obtained during a period of the dead time "d."

$$\overline{Vo2}(k+d) = \alpha 1\cdot Vo2(k) + \alpha 2\cdot Vo2(k-1) + \sum_{j=1}^{d}\beta j\cdot kcmd(k-j)$$

where α1=first-row, first-column element of $A^d$

α2=first-row, second-column element of $A^d$

βj=first row elements of $A^{j-1}\cdot B$ $$A = \begin{bmatrix} a1 & a2 \\ 1 & 0 \end{bmatrix} \tag{10}$$

$$B = \begin{bmatrix} b1 \\ 0 \end{bmatrix}$$

Past values kcmd(k−d2), kcmd(k−d2−1), . . . kcmd(k−d) for the desired air-fuel ratio error before the dead time d2 can be replaced with actual air-fuel ratio errors kact(k), kact (k−1), . . . kact(k−d+d2) by using the equation (2). As a result, the equation (11) is derived.

$$\overline{Vo2}(k+d) = \alpha 1 \cdot Vo2(k) + \alpha 2 \cdot Vo2(k-1) + \sum_{j=1}^{d2-1} \beta j \cdot kcmd(k-j) + \sum_{i=0}^{d-d2} \beta i + d2 \cdot kact(k-i) = \alpha 1 \cdot Vo2(k) + \alpha 2 \cdot Vo2(k-1) + \sum_{j=1}^{d2-1} \beta j \cdot kcmd(k-j) + \sum_{i=0}^{d1} \beta i + d2 \cdot kact(k-i) \quad (11)$$

The sliding mode controller 34 establishes a switching function σ so as to perform the sliding mode control, as shown in the equation (12).

$$\sigma(k)=s \cdot Vo2(k-1)+Vo2(k) \quad (12)$$

Vo2(k−1) indicates the sensor output error detected in the previous cycle as described above. Vo2(k) indicates the sensor output error detected in the current cycle. "s" is a setting parameter of the switching function σ, and is established to satisfy −1<s<1.

The equation in the case of σ(k)=0 is called an equivalent input system, which specifies the convergence characteristics of the sensor output error Vo2, or a controlled variable. Assuming σ(k)=0, the equation (12) is transformed to the equation (13).

$$Vo2(k)=-s \cdot Vo2(k-1) \quad (13)$$

Figure 7:
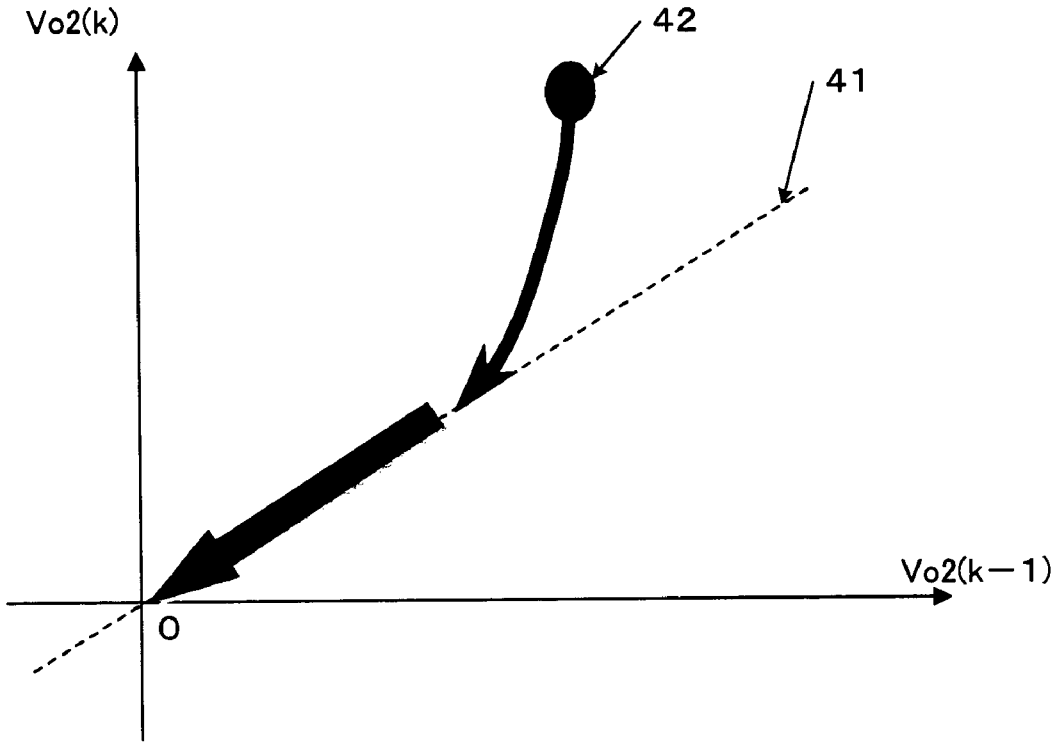
FIG. 7 schematically shows a switching line for a response assignment control according to one embodiment of the present invention.

Now, characteristics of the switching function σ will be described with reference to FIG. 7 and the equation (13). In FIG. 7, the equation (13) is shown as a line 41 on a phase plane with Vo2(k−1) being the horizontal axis and Vo2(k) being the vertical axis. The line 41 is referred to as a switching line. It is assumed that the initial value of a state variable (Vo2(k−1), Vo2(k)) that is a combination of Vo2(k−1) and Vo2(k) is shown by a point 42. The sliding mode control operates to place the state variable shown by the point 42 on the line 41 and then confine it on the line 41. According to the sliding mode control, since the state variable is held on the switching line 41, the state variable can highly stably converge to the origin 0 of the phase plane without being affected by disturbances or the like. In other words, by confining the state variable (Vo2(k·1), Vo2(k)) on such a stable system having no input as shown by the equation (13), the sensor output error Vo2 can converge to zero robustly against disturbances and modeling errors.

The switching function setting parameter "s" is a parameter which can be variably selected. Reduction (convergence) characteristics of the sensor output error Vo2 can be specified by the setting parameter "s."

Figure 8:
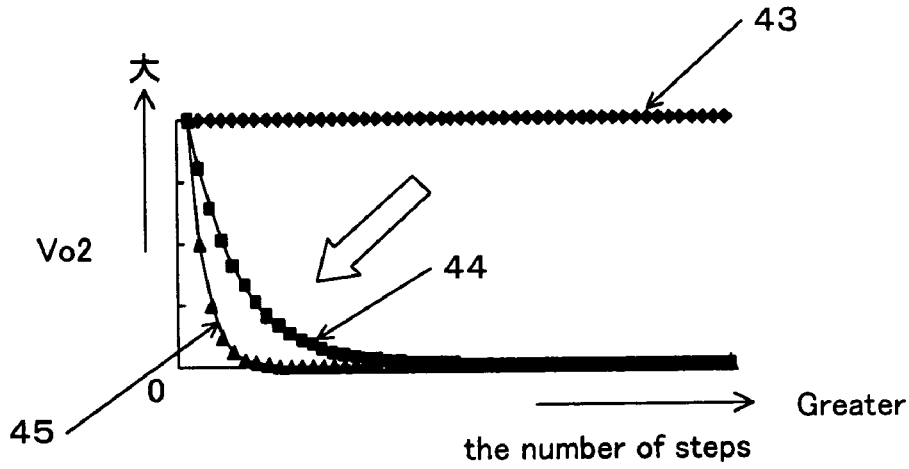
FIG. 8 shows response characteristics of a response assignment control according to one embodiment of the present invention.

FIG. 8 shows one example of response assignment characteristics of the sliding mode control. A line 43 shows a case in which the value of the setting parameter is "−1." A curve 44 shows a case in which the value of the setting parameter is "−0.8." A curve 45 shows a case in which the value of the setting parameter is "−0.5." As seen from the figure, the rate of convergence of the sensor output error Vo2 changes according to the value of the setting parameter "s." It is seen that the convergence rate becomes faster as the absolute value of "s" becomes smaller.

Three control inputs are determined to cause the value of the switching function σ to converge to zero. That is, a control input Ueq for confining the state variable on the switching line, a control input Urch for placing the state variable on the switching line, and a control input Uadp for placing the state variable on the switching line while suppressing modeling errors and disturbances. The three control inputs Ueq, Urch and Uadp are summed to determine a demand error Usl. The demand error Usl is used to calculate the desired air-fuel ratio error kcmd.

The equivalent control input Ueq needs to satisfy the equation (14) because it is an input for confining the state variable onto the switching line.

$$\sigma(k+1)=\sigma(k) \quad (14)$$

The equivalent control input Ueq that satisfies σ(k+1)=σ(k) is determined from the equations (9) and (12), as shown by the equation (15).

$$Ueq(k) = -\frac{1}{b1}[((a1-1)+s) \cdot Vo2(k+d) + (a2-s) \cdot Vo2(k+d-1)] \quad (15)$$

The reaching law input Urch has a value that depends on the value of the switching function σ. The reaching law Urch is determined in accordance with the equation (16). In the embodiment, the reaching law input Urch has a value proportional to the value of the switching function σ. Krch indicates a feedback gain of the reaching law, which is predetermined with, for example, simulation in which the stability and quick response of the convergence of the value of the switching function to zero (σ=0) are taken into consideration.

$$Urch(k) = -\frac{1}{b1} \cdot Krch \cdot \sigma(k+d) \quad (16)$$

The adaptive law input Uadp has a value that depends on an integrated value of the switching function σ. The adaptive law input Uadp is determined in accordance with the equation (17). In the embodiment, the adaptive law input Uadp has a value proportional to the integrated value of the switching function σ. Kadp indicates a feedback gain of the adaptive law, which is predetermined with, for example, simulation in which the stability and quick response of the convergence of the value of the switching function to zero (σ=0) are taken into consideration. ΔT indicates the period of a control cycle.

$$Uadp(k) = -\frac{1}{b1} \cdot Kadp \cdot \sum_{i=0}^{k+d} (\sigma(i) \cdot \Delta T) \quad (17)$$

Since the sensor output errors Vo2(k+d) and Vo2(k+d−1), and the value σ(k+d) of the switching function include the dead time "d," these values can not be directly obtained. Therefore, the equivalent control input Ueq is determined using an estimated errors $\overline{Vo2}$(k+d) and $\overline{Vo2}$(k+d−1) generated by the estimator 33.

$$Ueq(k) = -\frac{1}{b1}[((a1-1)+s) \cdot \overline{Vo2}(k+d) + (a2-s) \cdot \overline{Vo2}(k+d-1)] \quad (18)$$

A switching function $\overline{\sigma}$ is determined using the estimated errors generated by the estimator 33, as shown in the equation (19).

$$\overline{\sigma}=s \cdot \overline{Vo2}(k-1)+\overline{Vo2}(k) \quad (19)$$

The switching function $\overline{\sigma}$ is used to determine the reaching law input Urch and the adaptive law input Uadp.

$$Urch(k) = -\frac{1}{b1} \cdot Krch \cdot \overline{\sigma}(k+d) \tag{20}$$

$$Uadp(k) = -\frac{1}{b1} \cdot Kadp \cdot \sum_{i=0}^{k+d} (\overline{\sigma}(i) \cdot \Delta T) \tag{21}$$

As shown by the equation (22), the equivalent control input Ueq, the reaching law input Urch and the adaptive law input Uadp are added to determine a demand error Usl.

$$Usl(k)=Ueq(k)+Urch(k)+Uadp(k) \tag{22}$$

The limiter 35 performs a limiting process for the demand error Usl to determine the air-fuel ratio error kcmd. More specifically, if the demand error Usl is within an allowable range, the limiter 35 sets the air-fuel ratio error kcmd to the value of the demand error Usl. If the demand error Usl deviates from the allowable range, the limiter 35 sets the air-fuel ratio error kcmd to an upper or lower limit value of the allowable range.

As shown by reference number 29 in FIG. 3, the allowable range used by the limiter 35 is set to a range whose center is almost located in the window 27 and whose width is wider than that of the window 27. The allowable range is actively established in accordance with the demand error Usl, the operating state of the engine and the like. Even when the purification capability of the catalyst converter deviates from the optimal state shown by the window 27, the allowable range has a sufficient width to allow the catalyst converter to quickly return to the optimal state while suppressing variations in combustion conditions that may be caused by variations in the air-fuel ratio. Therefore, the purification rate of the catalyst converter can be kept at a high level so that undesired substances in exhaust gas are reduced.

More specifically, the allowable range is variably updated in accordance with the determined demand error Usl. For example, the allowable range is extended in accordance with deviation of the demand error Usl from the allowable range. On the other hand, when the demand error Usl is within the allowable range, the allowable range is reduced. Thus, the allowable range suitable for the demand error Usl, which defines the air-fuel ratio necessary to cause the output of the O2 sensor 17 to converge to the desired value, is established.

Furthermore, the allowable range is established to be narrower as the degree of instability of the output of the O2 sensor 17 becomes higher. The allowable range may be established in accordance with the operating state of the engine such as starting the engine, idling, and canceling fuel-cut operation.

The determined air-fuel ratio error kcmd is added to the base value FLAF/BASE to determine the desired air-fuel ratio KCMD. The desired air-fuel ratio KCMD is given to the exhaust system 19 or a controlled object, thereby causing the sensor output Vo2/OUT to converge to the desired value Vo2/TARGET.

Alternatively, the base value FLAF/BASE of the air-fuel ratio may be set in accordance with the adaptive law input Uadp determined by the sliding mode controller 34 after the completion of the limiting process by the limiter 35. More specifically, the base value FLAF/BASE is initialized to the stoichiometric air-fuel ratio. If the adaptive law input Uadp exceeds a predetermined upper limit value, the base value FLAF/BASE is increased by a predetermined amount. If the adaptive law input Uadp is below a predetermined lower limit value, the base value FLAF/BASE is decreased by a predetermined amount. If the adaptive law input Uadp is between the upper and lower limit values, the base value FLAF/BASE is maintained. The base value FLAF/BASE thus set is used in the next control cycle. Thus, the base value FLAF/BASE is adjusted to be a central value for the desired air-fuel ratio KCMD.

By performing the above setting process of the base value FLAF/BASE in combination with the above limiting process, the allowable range of the demand error Usl is balanced between positive and negative values. It is preferable that the setting process for the base value FLAF/BASE is performed when it is determined that the output Vo2/OUT of the O2 sensor substantially converges to the desired value Vo2/TARGET and that the sliding mode control is in a stable state.

Air-fuel Ratio Control Flow

Figure 9:
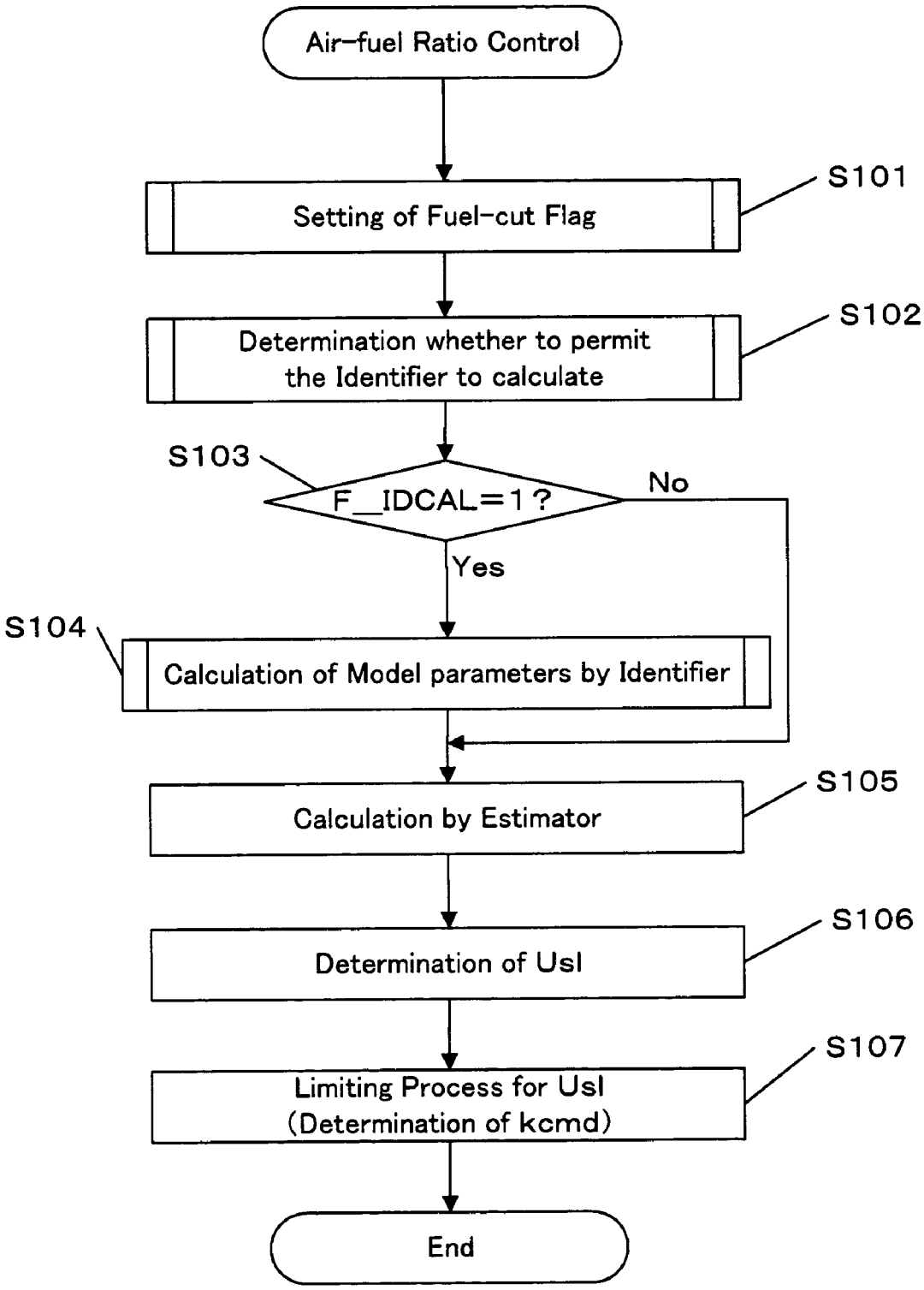
FIG. 9 is a flowchart of an air-fuel control process according to one embodiment of the present invention.
Figure 10:
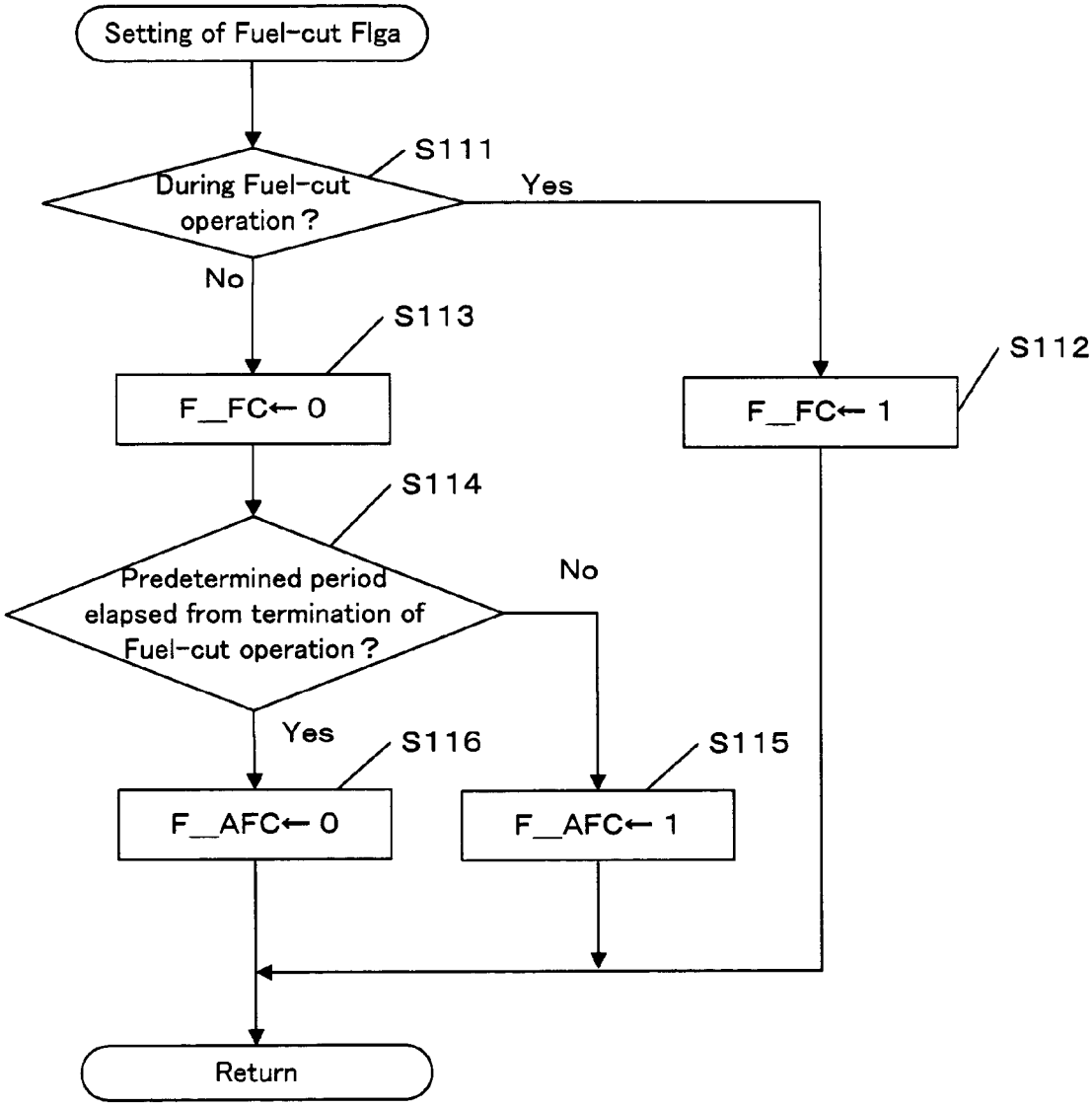
FIG. 10 is a flowchart of a process for establishing a fuel-cut flag according to one embodiment of the present invention.
Figure 11:
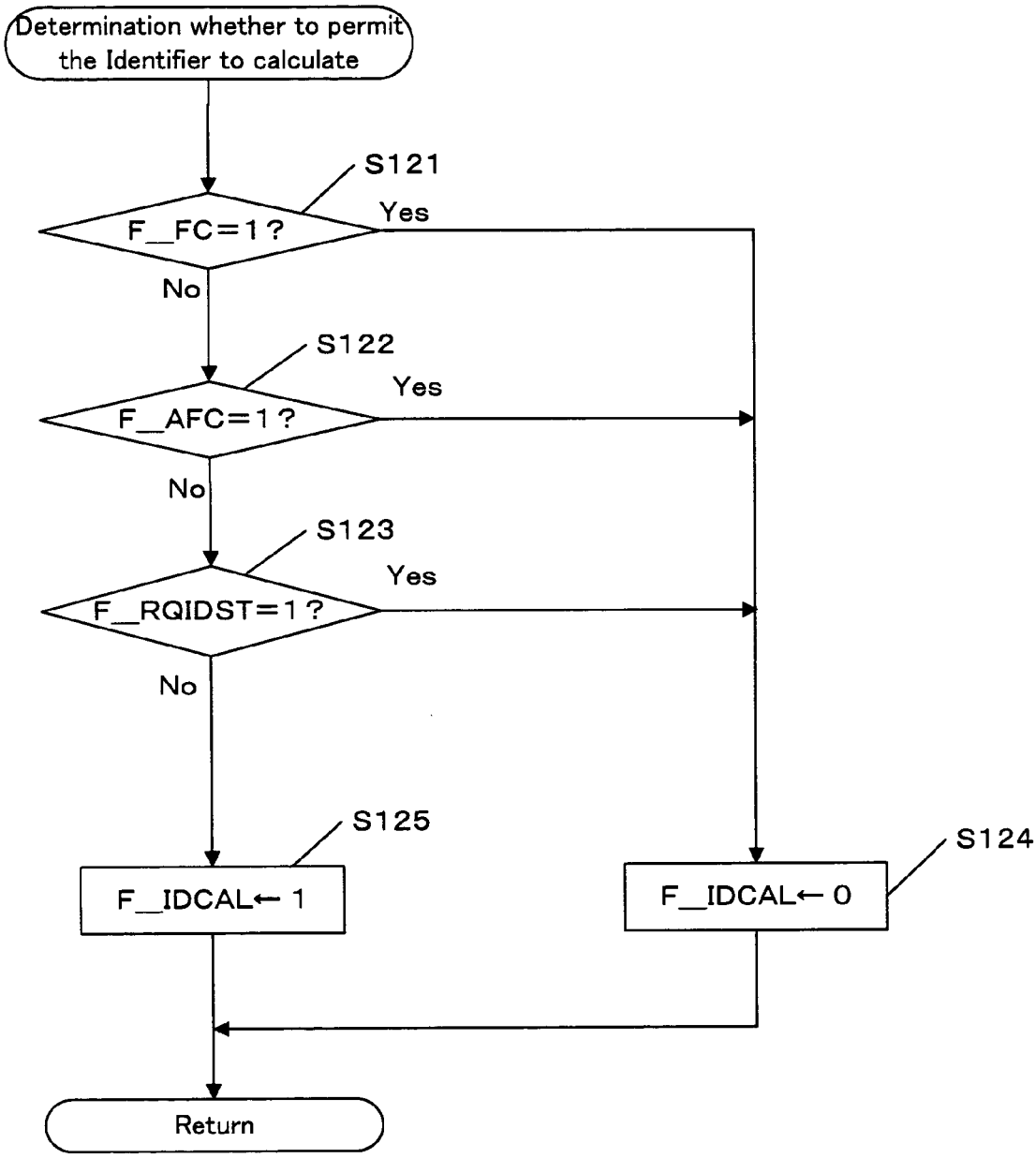
FIG. 11 is a flowchart of a process for determining whether the calculation by an identifier is permitted according to one embodiment of the present invention.

FIG. 9 shows a flowchart of a process for controlling an air-fuel ratio according to one embodiment of the present invention. In step S101, a process for setting a fuel-cut flag is performed (FIG. 10). In step S102, it is determined whether to permit the identifier to calculate the model parameters (FIG. 11).

Figure 12:
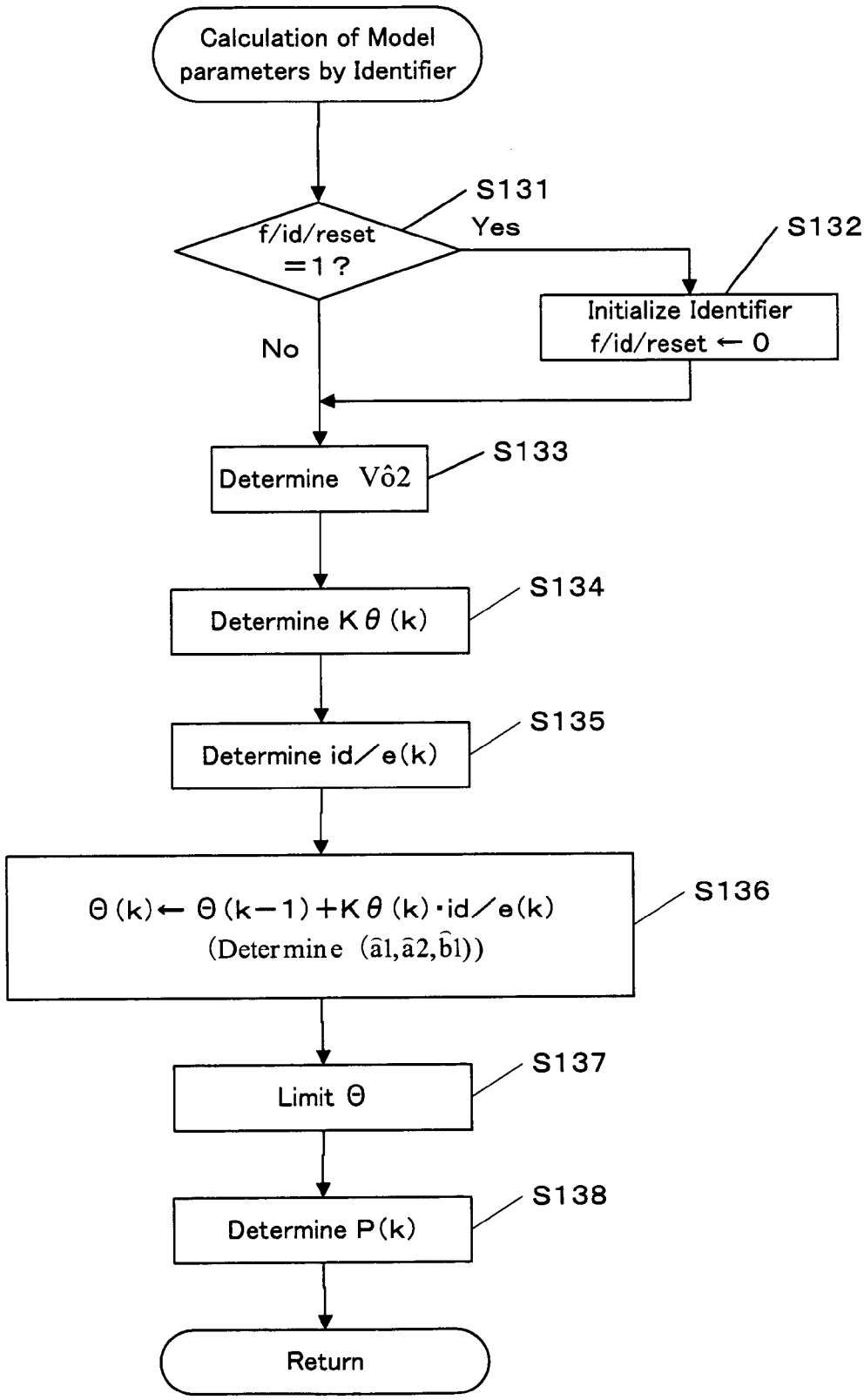
FIG. 12 is a flowchart of a process for calculating model parameters according to one embodiment of the present invention.

In step S103, the value of a flag F_IDCAL that is to be set to one when the calculation by the identifier is permitted is examined. If F_IDCAL=1, the process proceeds to step S104, in which the identifier calculates the model parameters a1, a2 and b1 (FIG. 12). If F_IDCAL=0, the process skips the step S104.

In step S105, the estimator uses the model parameters calculated in step S104 to determine the estimated error $\overline{Vo2}$ according to the above equation (11).

In step S106, the switching function $\overline{\sigma}$, the equivalent control input Ueq, the adaptive law input Uadp, and the reaching law input Urch are determined according to the above equations (18) through (21). The control input Usl is determined according to the equation (22).

In step S107, the limiter performs the above-described limiting process for the control input Usl to determine the desired air-fuel ratio error kcmd.

FIG. 10 shows a flowchart of a process for setting the fuel-cut flag, which is performed in step S101 of FIG. 9. In step S111, it is determined whether fuel-cut operation is being performed. If the fuel-cut operation is being performed, the fuel-cut flag F_FC is set to one (S112). If the fuel-cut operation is not being performed, the fuel-cut flag F_FC is set to zero (S113).

In step S114, it is determined whether a predetermined period has elapsed after termination of the fuel-cut operation. If the predetermined period has not elapsed, a post-fuel-cut flag F_AFC is set to one (S115). If the predetermined period has elapsed, the post-fuel-cut flag F_AFC is set to zero (S116).

FIG. 11 is a flowchart of a process for determining whether to permit the identifier to calculate the model parameters, which is performed in step S102 of FIG. 9. In step S121, the value of the fuel-cut flag F_FC is examined. If F_FC=1, the process proceeds to step S124. A permission flag F_IDCAL is set to zero, which indicates that the identifier is not permitted to calculate the model parameters. Thus, the calculation of the model parameters by the identifier is stopped when fuel-cut operation is being performed.

In step S122, the value of the post-fuel-cut flag F_AFC is examined. If F_AFC=1, the process proceeds to step S124. The permission flag F_IDCAL is set to zero, which indicates that the identifier is not permitted to calculate the model parameters. Thus, the calculation of the model parameters by the identifier is stopped during a predetermined period after fuel-cut operation is stopped.

In step S123, the value of a flag F_RQIDST is examined. The flag F_RQIDST is a flag that is to be set to one when engine operation with a lean air-fuel ratio (hereinafter, referred to as "lean engine operation") is activated immediately after the engine is started. The flag F_RQIDST is also set to one when lean engine operation is activated so as to improve fuel efficiency. The flag F_RQIDST is kept at a value of one when the lean engine operation is being performed and during a predetermined period after the lean engine operation is stopped. The flag F_RQIDST is reset to zero when the predetermined period has elapsed from the termination of the lean engine operation.

If F_RQIDST=1, the process proceeds to step S124. The permission flag F_IDCAL is set to zero, which indicates that the identifier is not permitted to calculate the model parameters. Thus, the calculation of the model parameters by the identifier is stopped when the engine is operating with a lean air-fuel ratio and during a predetermined period after the engine stops operating with a lean air-fuel ratio.

If all of the answers of the determination steps S121 through S123 are "NO," the permission flag F_IDCAL is set to one (S125).

FIG. 12 shows a flowchart of a process for calculating the model parameters, which is performed in step S104 of FIG. 9.

In step S131, the value of a reset flag f/id/reset is examined. The reset flag f/id/reset is a flag that is to be set to one when it is determined that the identifier is to be initialized. For example, the reset flag f/id/reset is set to one when the O2 sensor or a full range air-fuel ratio sensor (LAF sensor) is not activated or when the engine is in an operating state in which the ignition timing thereof is controlled to be retarded for early activation of the catalyst immediately after the engine is started.

If the value of the reset flag f/id/reset is one, the identifier is initialized in step S132. Specifically, the value of each of model parameters $\hat{a}1$, $\hat{a}2$ and $\hat{b}1$ is set to a predetermined initial value. Each element of the matrix P, which is used to calculate the model parameters as shown in the above equations (5) through (8), is set to a predetermined initial value. In step S132, the reset flag f/id/reset is set to zero.

If the value of the reset flag f/id/reset is not one, the process proceeds to step S133, in which $\hat{V}o2(k)$ for the current cycle is calculated according to the above equation (3). The process proceeds to step S134, in which the vector $K\theta(k)$ is determined according to the above equation (7). In step S135, the identification error id/e(k) is determined according to the above equation (4).

The exhaust system has low-pass characteristics. It is preferable that the model parameters a1, a2 and b1 are identified taking into account behavior of the exhaust system in a low-frequency region. That is, it is preferable to apply a low-pass filtering process to the value "$Vo2-\overline{Vo2}$" obtained by the equation (4) to determine the identification error id/e. Alternatively, a low-pass filtering process may be applied to each of the sensor output error Vo2 and the sensor output error $\overline{Vo2}$. The identification error id/e is determined by subtracting the low-pass filtered $\overline{Vo2}$ from the low-pass filtered Vo2.

In step S136, the vector $K\theta$ determined in step S134 and the identification error id/e determined in step S135 are used to determine the vector $\theta(k)$ according to the above equation (6). Thus, the model parameters $\hat{a}1(k)$, $\hat{a}2(k)$ and $\hat{b}1(k)$ for the current cycle are determined.

In step S137, the values of the model parameters determined in step S136 are limited so as to reduce high-frequency vibration in the desired air fuel ratio KCMD. In step S138, the matrix P(k) used in the next control cycle is calculated according to the above equation (8).

Figure 13:
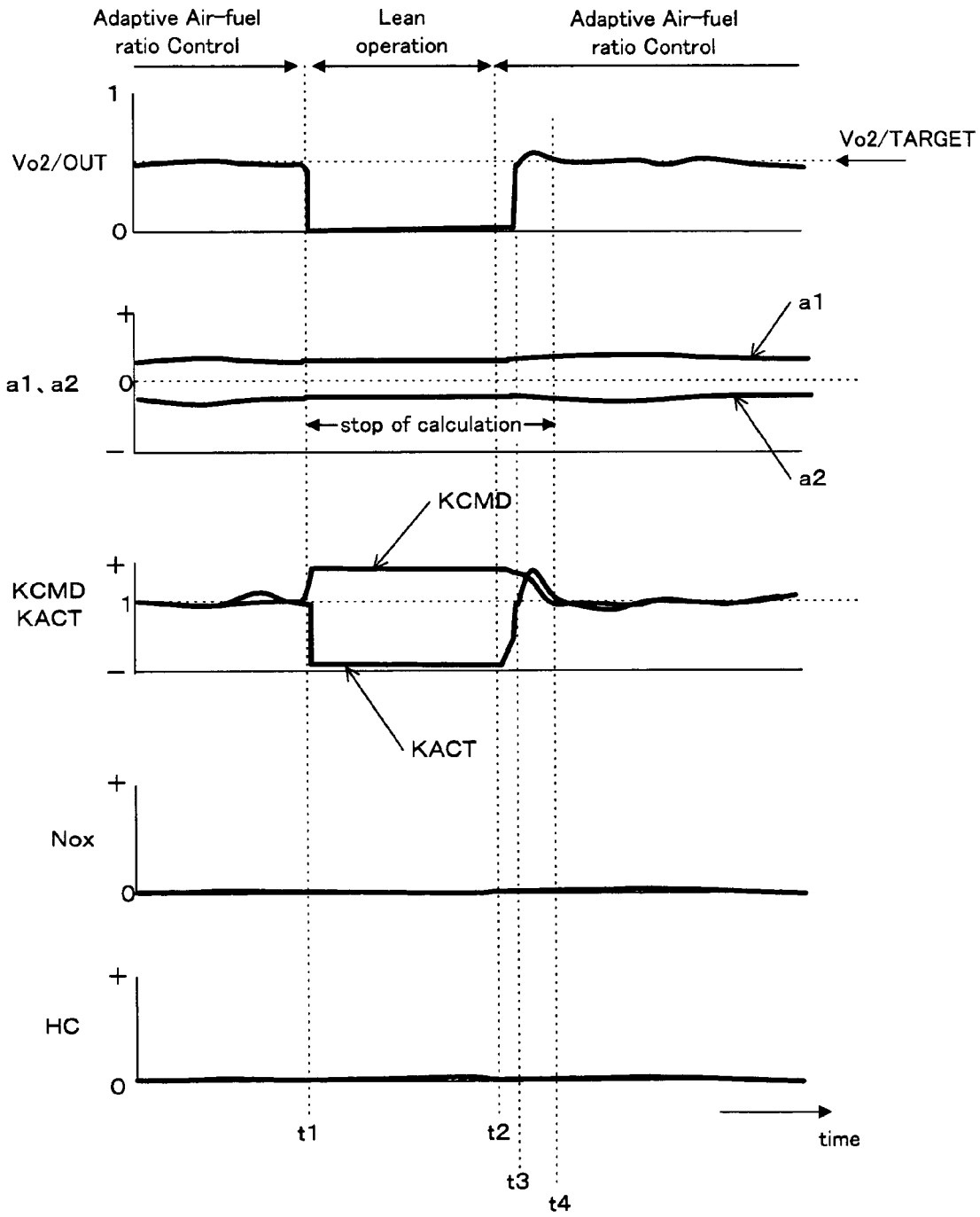
FIG. 13 shows behavior of an exhaust gas sensor output, model parameters, a desired air-fuel ratio, an actual air-fuel ratio, and amount of undesired substances contained in exhaust gas during and immediately after lean engine operation according to one embodiment of the present invention.

FIG. 13 shows behavior of the output Vo2/OUT from the O2 sensor, the model parameters a1 and a2, the desired air-fuel ratio KCMD, the actual air-fuel ratio KACT, and the amount of undesired substances HC and NOx in exhaust gas during and immediately after lean engine operation according to one embodiment of the invention.

The calculation of the model parameters by the identifier is stopped during the lean engine operation (t1 to t2) and during a predetermined period (t2 to t4) after the lean engine operation is stopped. During a period from t1 to t4, each of the model parameters a1, a2 and b1 (b1 is not shown) are held at a value last calculated before the time t1 at which the lean engine operation is started. During the period from t1 to t4, the desired air-fuel ratio KCMD is continuously calculated using the held model parameters a1, a2, and b1.

During a period from t1 to t2, the output Vo2/OUT from the O2 sensor and the actual air-fuel ratio KACT exhibit a lean air-fuel ratio. Since the air-fuel ratio is lean, the desired air-fuel ratio KCMD exhibits a value larger than one. During the lean engine operation, the above adaptive air-fuel ratio control for converging the air-fuel ratio to the desired air-fuel ratio KCMD is not performed.

Figure 14:
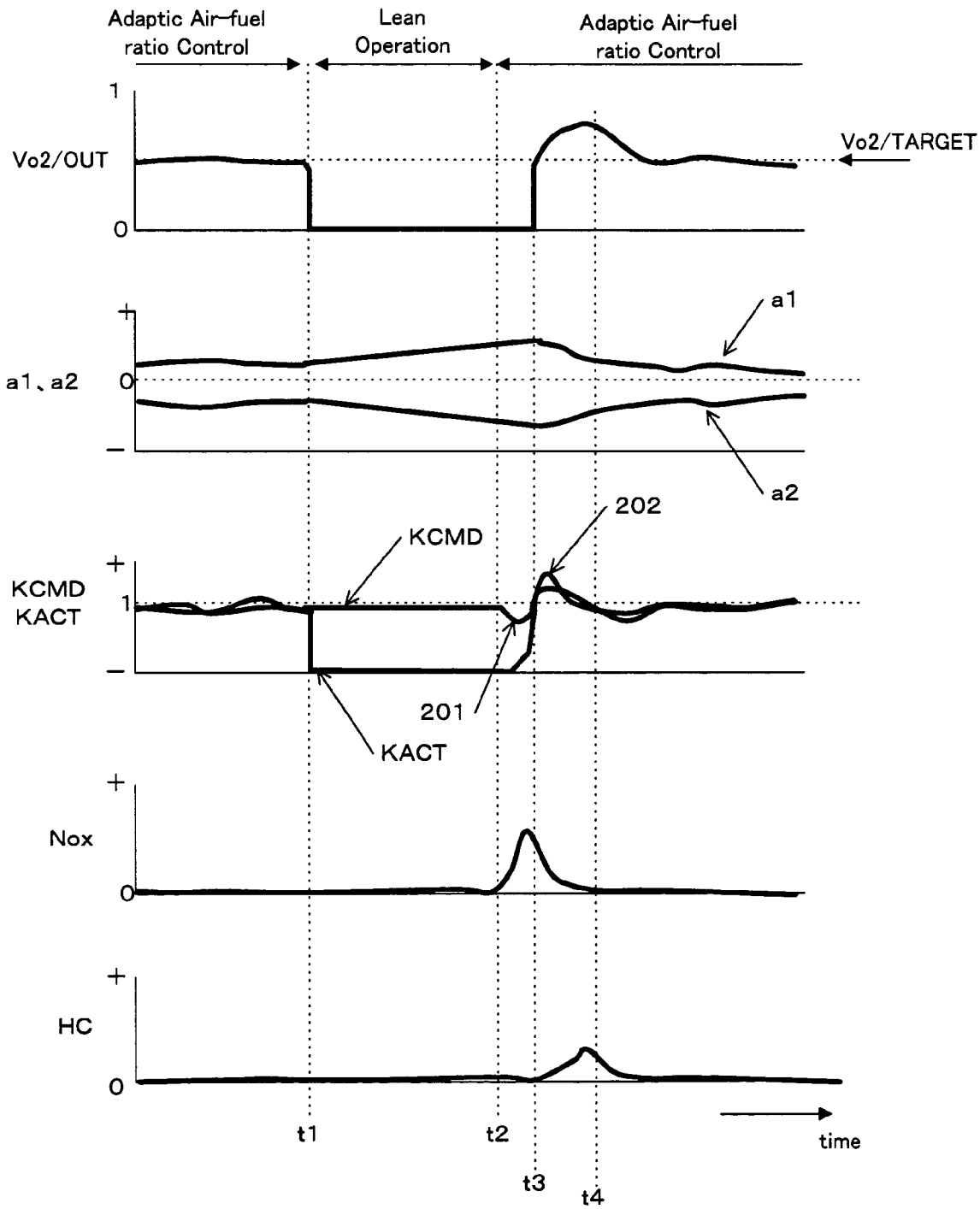
FIG. 14 shows behavior of an exhaust gas sensor output, model parameters, a desired air-fuel ratio, an actual air-fuel ratio, and amount of undesired substances of exhaust gas during and immediately after lean engine operation according to a conventional air-fuel ratio control.

The lean engine operation is terminated at time t2. The adaptive air-fuel ratio control as described above is started. The desired air-fuel ratio KCMD is calculated so that the output Vo2/OUT from the O2 sensor converges to the desired value Vo2/TARGET. During a period from t2 to t3, the desired air-fuel ratio KCMD exhibits a rich air-fuel ratio, which causes the air-fuel ratio to promptly return from the lean side. As seen from the comparison with FIG. 14, since the desired air-fuel ratio KCMD is not set to a lean air-fuel ratio, it is prevented that the air-fuel ratio is further manipulated toward the lean side, thereby reducing the amount of discharged NOx.

During a period from t3 to t4, the desired air-fuel ratio changes from the rich side to the lean side, which causes the enriched air-fuel ratio to converge to the desired value. As seen from the comparison with FIG. 14, since the desired air-fuel ratio KCMD does not change toward the rich side, it is prevented that the rich air-fuel ratio is further manipulated toward the rich side, thereby reducing the amount of discharged HC. At time t4, the calculation of the model parameters by the identifier is started.

Thus, since the calculation of the model parameters by the identifier is stopped during the period from t1 to t4, no drift occurs in the model parameters. An appropriate desired air-fuel ratio KCMD can be calculated from the time at which the lean engine operation is terminated.

The above adaptive air-fuel ratio uses the desired air-fuel ratio KCMD, the sensor output Vo2/OUT from the O2 sensor and the actual air-fuel ratio KACT determined in the past cycles to determine the control input Usl. Since an appropriate desired air-fuel ratio KCMD is continuously calculated during the period from t1 to t4, such an adaptive air fuel ratio control can be stably performed from the time at which the lean engine operation is terminated.

In the above described embodiments, the sliding mode control is used as the adaptive air-fuel ratio control. Alternatively, other response assignment control may be used as the adaptive air-fuel ratio control.

The invention may be applied to an engine to be used in a vessel-propelling machine such as an outboard motor in which a crankshaft is disposed in the perpendicular direction.

What is claimed is:

1. A method for controlling an air-fuel ratio of an internal combustion engine, comprising the steps of:

receiving an output of an exhaust gas sensor that detects oxygen concentration of exhaust gas;

calculating model parameters for a model of an object controlled by the air-fuel ratio control based on the output of the exhaust gas sensor, the controlled object being a system including a catalyst and the exhaust gas sensor in an exhaust manifold of the engine;

determining a desired air-fuel ratio with use of the model parameters so that the output of the exhaust gas sensor converges to a desired value;

controlling the air-fuel ratio based on the desired air-fuel ratio;

stopping the calculation of the model parameters when the engine is operating with a lean air-fuel ratio and during a predetermined period after the engine stops operating with a lean air-fuel ratio; and during the stopping of the calculation, continuing the determination of the desired air-fuel ratio, with use of the model parameters that were last calculated by the identifier before the engine started the operation with a lean air-fuel ratio, wherein both the continuing the determination of the desired air-fuel ratio and the stopping of the identifier are performed in the same way for all cylinders in the engine.

2. The method of claim 1, further comprising the steps of:

stopping the calculation of the model parameters when fuel-cut operation that stops fuel supply to the engine is being performed and during a predetermined period after the fuel-cut operation is stopped.

3. The method of claim 1, wherein the engine operates with a lean air-fuel ratio to improve fuel efficiency, or to reduce the amount of undesired substances included in exhaust gas immediately after the engine is started.

4. The method of claim 1, further comprising the step of performing a response assignment control to control the air-fuel ratio.

5. The method of claim 1, wherein the exhaust system extends from an air-fuel ratio sensor through a catalyst converter to the exhaust gas sensor, the air-fuel ratio sensor provided upstream of the catalyst converter, the exhaust gas sensor provided downstream of the catalyst converter.

6. The method of claim 5, wherein the exhaust system is modeled so that a control input of the model is the output of the air-fuel ratio sensor and a control output of the model is the output of the exhaust gas sensor.

7. An apparatus for controlling an air-fuel ratio of an internal combustion engine, said apparatus comprising:

exhaust gas sensor means for detecting oxygen concentration of exhaust gas;

identifier means for calculating model parameters for a model of an object controlled by the air-fuel ratio control based on the output of the exhaust gas sensor means, the controlled object being a system including a catalyst and the exhaust gas sensor in an exhaust manifold of the engine; and control means for controlling said apparatus, said control means configured to determine a desired air-fuel ratio with use of the model parameters so that the output of the exhaust gas sensor means converges to a desired value;

control the air-fuel ratio based on the desired air-fuel ratio;

stop the identifier means from calculating the model parameters when the engine is operating with a lean air-fuel ratio and during a predetermined period after the engine stops operating with a lean air-fuel ratio; and during the stop of the identifier, continue the determination of the desired air-fuel ratio, with use of the model parameters that were last calculated by the identifier before the engine started the operation with a lean air-fuel ratio, wherein both the continuing the determination of the desired air-fuel ratio and the stopping of the identifier are performed in the same way for all cylinders in the engine.

8. The air-fuel ratio controller of claim 7, wherein the control means is further configured to stop the identifier means from calculating the model parameters when fuel-cut operation that stops fuel supply to the engine is being performed and during a predetermined period after the fuel-cut operation is stopped.

9. The air-fuel ratio controller of claim 7, wherein the engine operates with a lean air-fuel ratio to improve fuel efficiency, or to reduce the amount of undesired substances included in exhaust gas immediately after the engine is started.

10. The air-fuel ratio controller of claim 7, wherein the control means is further configured to perform a response assignment control to control the air-fuel ratio.

11. The air-fuel ratio controller of claim 7, wherein the exhaust system extends from an air-fuel ratio sensor means through a catalyst converter to the exhaust gas sensor means, the air-fuel ratio sensor provided upstream of the catalyst converter, the exhaust gas sensor means provided downstream of the catalyst converter.

12. The air-fuel ratio controller of claim 11, wherein the exhaust system is modeled so that a control input of the model is the output of the air-fuel ratio sensor means and a control output of the model is the output of the exhaust gas sensor means.

13. An apparatus for controlling an air-fuel ratio of an internal combustion engine, said apparatus comprising:

an exhaust gas sensor for detecting oxygen concentration of exhaust gas;

an identifier for calculating model parameters for a model of an object controlled by the air-fuel ratio control based on the output of the exhaust gas sensor, the controlled object being a system including a catalyst and the exhaust gas sensor in an exhaust manifold of the engine; and a control unit configured to determine a desired air-fuel ratio with use of the model parameters so that the output of the exhaust gas sensor converges to a desired value;

control the air-fuel ratio based on the desired air-fuel ratio;

stop the identifier from calculating the model parameters when the engine is operating with a lean air-fuel ratio and during a predetermined period after the engine stops operating with a lean air-fuel ratio; and during the stop of the identifier, continue the determination of the desired air-fuel ratio, with use if the model parameters that were last calculated by the identifier before the engine started the operation with a lean air-fuel ratio, wherein both the continuing the determination of the desired air-fuel ratio and the stopping of the identifier are performed in the same way for all cylinders in the engine.

14. The air-fuel ratio controller of claim 13, wherein the control unit is further configured to stop the identifier from calculating the model parameters when fuel-cut operation that stops fuel supply to the engine is being performed and during a predetermined period after the fuel-cut operation is stopped.

15. The air-fuel ratio controller of claim 13, wherein the engine operates with a lean air-fuel ratio to improve fuel efficiency, or to reduce the amount of undesired substances included in exhaust gas immediately after the engine is started.

16. The air-fuel ratio controller of claim 13, wherein the control unit is further configured to perform a response assignment control to control the air-fuel ratio.

17. The air-fuel ratio controller of claim 13, wherein the exhaust system extends from an air-fuel ratio sensor through a catalyst converter to the exhaust gas sensor, the air-fuel ratio sensor provided upstream of the catalyst converter, the exhaust gas sensor provided downstream of the catalyst converter.

18. The air-fuel ratio controller of claim 17, wherein the exhaust system is modeled so that a control input of the model is the output of the air-fuel ratio sensor and a control output of the model is the output of the exhaust gas sensor.

19. A computer program stored on a computer readable medium for use in controlling an air-fuel ratio of an internal combustion engine, the computer program comprising:

program code for receiving an output of an exhaust gas sensor that detects oxygen concentration of exhaust gas;

program code for calculating model parameters for a model of an object controlled by the air-fuel ratio control based on the output of the exhaust gas sensor, the controlled object being a system including a catalyst and the exhaust gas sensor in an exhaust manifold of the engine;

program code for determining a desired air-fuel ratio with use of the model parameters so that the output of the exhaust gas sensor converges to a desired value;

program code for controlling the air-fuel ratio based on the desired air-fuel ratio;

program code for stopping the calculation of the model parameters when the engine is operating with a lean air-fuel ratio and during a predetermined period after the engine stops operating with a lean air-fuel ratio; and program code for, during the stopping of the calculation, continuing the determination of the desired air-fuel ratio, with use of the model parameters that were last calculated by the identifier before the engine started the operation with a lean air-fuel ratio, wherein both the continuing the determination of the desired air-fuel ratio and the stopping of the identifier are performed in the same way for all cylinders in the engine.

20. The computer program of claim 19, further comprising program code for stopping the calculation of the model parameters when fuel-cut operation that stops fuel supply to the engine is being performed and during a predetermined period after the fuel-cut operation is stopped.

21. The computer program of claim 19, wherein the engine operates with a lean air-fuel ratio to improve fuel efficiency, or to reduce the amount of undesired substances included in exhaust gas immediately after the engine is started.

22. The computer program of claim 19, further comprising program code for performing a response assignment control to control the air-fuel ratio.

23. The computer program of claim 19, wherein the exhaust system extends from an air-fuel ratio sensor through a catalyst converter to the exhaust gas sensor, the air-fuel ratio sensor provided upstream of the catalyst converter, the exhaust gas sensor provided downstream of the catalyst converter.

24. The computer program of claim 23, wherein the exhaust system is modeled so that a control input of the model is the output of the air-fuel ratio sensor and a control output of the model is the output of the exhaust gas sensor.

* * * * *